US009134645B2

(12) United States Patent
Yoshida

(10) Patent No.: US 9,134,645 B2
(45) Date of Patent: Sep. 15, 2015

(54) IMAGE FORMING APPARATUS

(71) Applicant: CANON KABUSHIKI KAISHA, Tokyo (JP)

(72) Inventor: Michihiro Yoshida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/470,117

(22) Filed: Aug. 27, 2014

(65) Prior Publication Data

US 2014/0363182 A1 Dec. 11, 2014

Related U.S. Application Data

(63) Continuation of application No. PCT/JP2013/056042, filed on Feb. 27, 2013.

(30) Foreign Application Priority Data

Feb. 27, 2012 (JP) ..... 2012-040645

(51) Int. Cl.
*G03G 15/02* (2006.01)
*G03G 15/00* (2006.01)

(52) U.S. Cl.
CPC ..... *G03G 15/0266* (2013.01); *G03G 15/0283* (2013.01); *G03G 15/5004* (2013.01)

(58) Field of Classification Search
CPC ..... G03G 15/0266; G03G 15/0283; G03G 15/5004
See application file for complete search history.

(56) References Cited

U.S. PATENT DOCUMENTS

| | | | | |
|---|---|---|---|---|
| 7,684,719 | B2 * | 3/2010 | Kitajima | 399/50 |
| 8,170,433 | B2 * | 5/2012 | Kubo | 399/50 |
| 2001/0019669 | A1 | 9/2001 | Watanabe et al. | |
| 2010/0239286 | A1 * | 9/2010 | Hanashi | 399/50 |
| 2012/0033984 | A1 * | 2/2012 | Ikeda | 399/50 |
| 2013/0114974 | A1 | 5/2013 | Yoshida | |
| 2014/0363182 | A1 * | 12/2014 | Yoshida | 399/50 |

FOREIGN PATENT DOCUMENTS

| | | | |
|---|---|---|---|
| JP | 08-190254 | A | 7/1996 |
| JP | 2001-201920 | A | 7/2001 |
| JP | 2001-201921 | A | 7/2001 |
| JP | 2008-015268 | A | 1/2008 |

* cited by examiner

*Primary Examiner* — W B Perkey
(74) *Attorney, Agent, or Firm* — Fitzpatrick, Cella, Harper & Scinto

(57) ABSTRACT

An image forming apparatus capable of suppressing deterioration of a charger although an amount of use of the charger is actually small is provided. For that purpose, the image forming apparatus executes simple control of discharge current control in which at least one charging bias smaller in number than number of kinds of test biases in full control of the discharge current control is applied to the charger after a power source is turned on and before an image formation start signal is inputted, and on the basis of a current detected by the detector when the charging bias is applied, selects one from a plurality of modes including a first mode in which a charging bias is set by executing the full control of the discharge current control and including a second member in which the charging bias determined by full control of discharge current control without executing the full control of the discharge current control.

13 Claims, 12 Drawing Sheets

IMAGE FORMING APPARATUS

TECHNICAL FIELD

The present invention relates to an image forming apparatus such as a copying machine, a printer, a facsimile machine, a multi-function machine having a plurality of functions of these machines, and so on.

BACKGROUND ART

In order to stabilize electric discharge irrespective of an electric resistance fluctuation, of a charging roller (charger) as a charging member, due to a change in environment in which the image forming apparatus is provided and in environment of an inside of the image forming apparatus or irrespective of an electric resistance fluctuation of the charging member due to deposition of a toner and an external additive on the charging member with an increase in number of sheets of image formation, discharge current control, in an image formation preparatory rotation period from input of a print signal until an image forming step operation is actually made, in which a value of an AC current flowing when AC voltages having peak-to-peak voltages of 6 kinds are applied to the charger is measured and the peak-to-peak voltage of the AC voltage to be applied during image formation is determined on the basis of the measured AC current value is described in Japanese Laid-Open Patent Application (JP-A) 2001-201920.

As described above, it is expected that the electric resistance fluctuation of the charging member is generated, and therefore the discharge current control may preferably be carried out, in addition to the image formation preparatory rotation period described in JP-A 2001-201920, during turning-on of a discharge, in the case where the image forming apparatus is left standing for a predetermined period from the last image formation or every predetermined sheet number of the image formation. However, a manner in which the image forming apparatus is used varies.

An operation of the power switch (hard switch) is performed every day, and therefore the discharge current control is carried out every turning-on of the power switch every day. Further, in the case where the image form sheet number during a day (in a period from the turning-on of the power switch to a turning-off of the power switch), a period in which the image forming apparatus is left standing without being subjected to the image formation is long, so that the discharge current control is to be carried out every start of image formation after a lapse of a predetermined time from an end of last image formation. In the case where the image formation sheet number during the day as described above or the like case, a proportion of an energization time or a discharging time to the charging member in the discharge current control becomes large with respect to the energization time or the discharging time in the image forming operation. For that reason, the proportion largely influences a lifetime of the charging member in some cases. Particularly, in the case where the image forming apparatus is disposed in an environment such that equipment such as an air conditioner is provided and a temperature change is less, although the electric resistance fluctuation of the charging member is less and therefore necessity for effecting the discharge current control is relatively low, the discharge current control is carried out every turning-on of the power switch every day or every start of the image formation after the lapse of the predetermined time from the end of the last image formation, so that the charging member as the charger is deteriorated although a time in which the image forming operation is actually performed is small, and thus there was the case where the charging member or a process cartridge in which the charging member was incorporated had to be exchanged.

SUMMARY OF THE INVENTION

Problem to be Solved by Invention

An objection of the present invention is to provide an image forming apparatus capable of suppressing a deterioration of a charger by carrying out discharge current control every turning-on of a power switch or every start of image formation after a lapse of a predetermined time from an end of last image formation although a time actually subjected to the image formation is short.

Means for Solving Problem

According to the present invention, there is provided an image forming apparatus comprising: a photosensitive member; a charger for electrically charging the photosensitive member when an image is formed on the photosensitive member; a bias applying device for applying, to the charger, a charging bias including a DC voltage and an AC voltage which are superimposed; a detector for detecting a current passing through the charger; a regulator for regulating a peak-to-peak voltage of the charging bias on the basis of a current detected by the detector when a plurality of test biases different in peak-to-peak voltage from each other are applied in a test mode in which the plurality of test biases are applied to the charger; and a selector for selecting one from a plurality of modes including a first mode in which the charging bias is set by executing the test mode and including a second mode in which the charging bias regulated though a last test mode without executing the test mode is set, on the basis of the current detected by the detector when at least one check bias smaller in number than number of kinds of the test biases is applied in a check mode in which the check bias is applied after a power source of the image forming apparatus is turned on and before an image formation start signal is inputted.

EMBODIMENTS FOR CARRYING OUT INVENTION

Hereinbelow, embodiments of the present invention will be described with reference to the drawings.

In the following, an image forming apparatus according to the present invention will be further specifically described in conformity with the drawings. However, dimensions, materials and shapes of constituent elements and their relative arrangements and the like described in the following embodiments should be changed appropriately depending on structures and various conditions of devices to which the present invention is applied, and the scope of the present invention is not intended to be limited to the following embodiments.

Embodiment 1

1. Image Forming Apparatus

Figure 1:
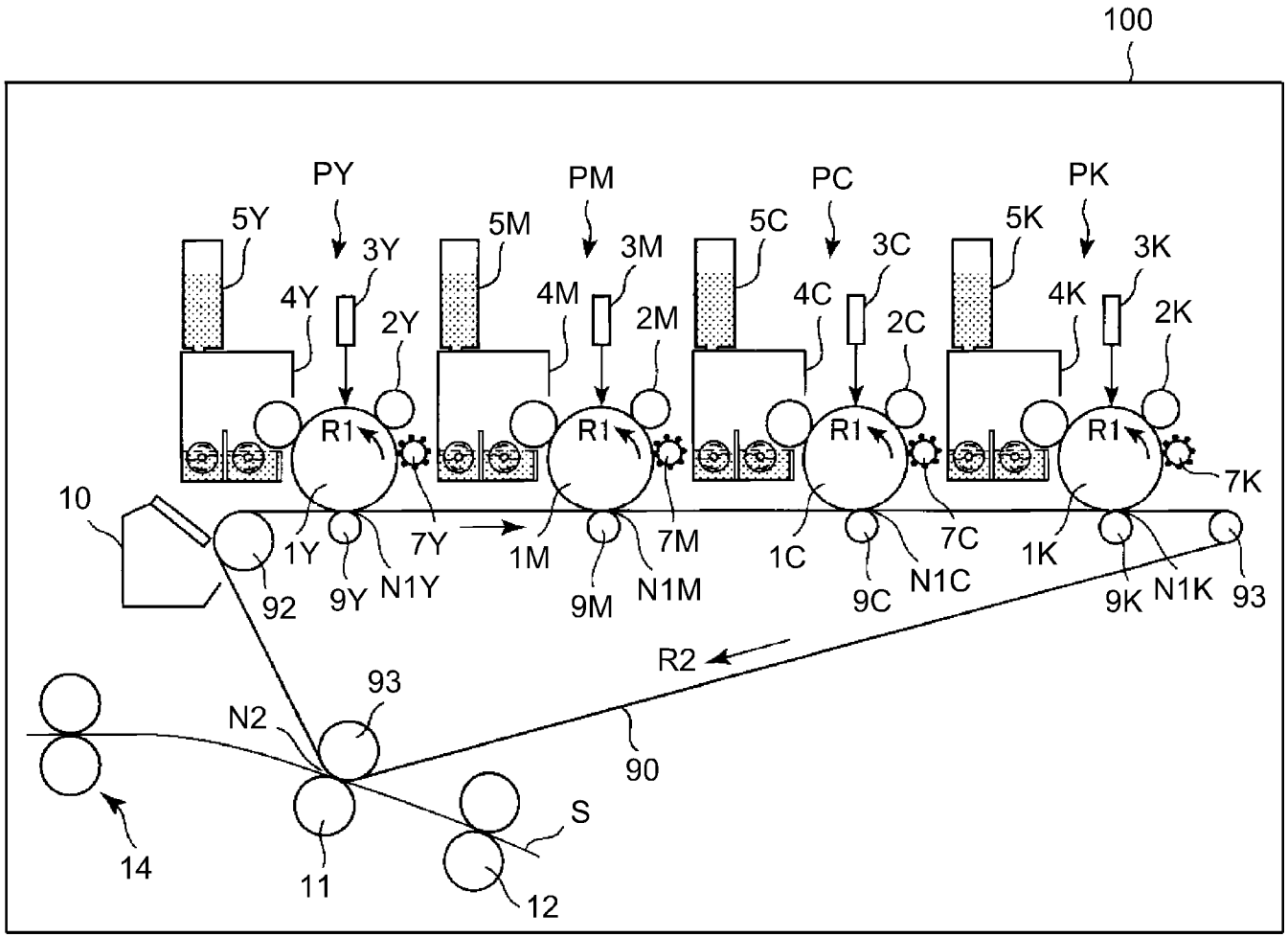
FIG. 1 is a schematic sectional view for illustrating a general structure of an image forming apparatus according to an embodiment of the present invention.
Figure 2:
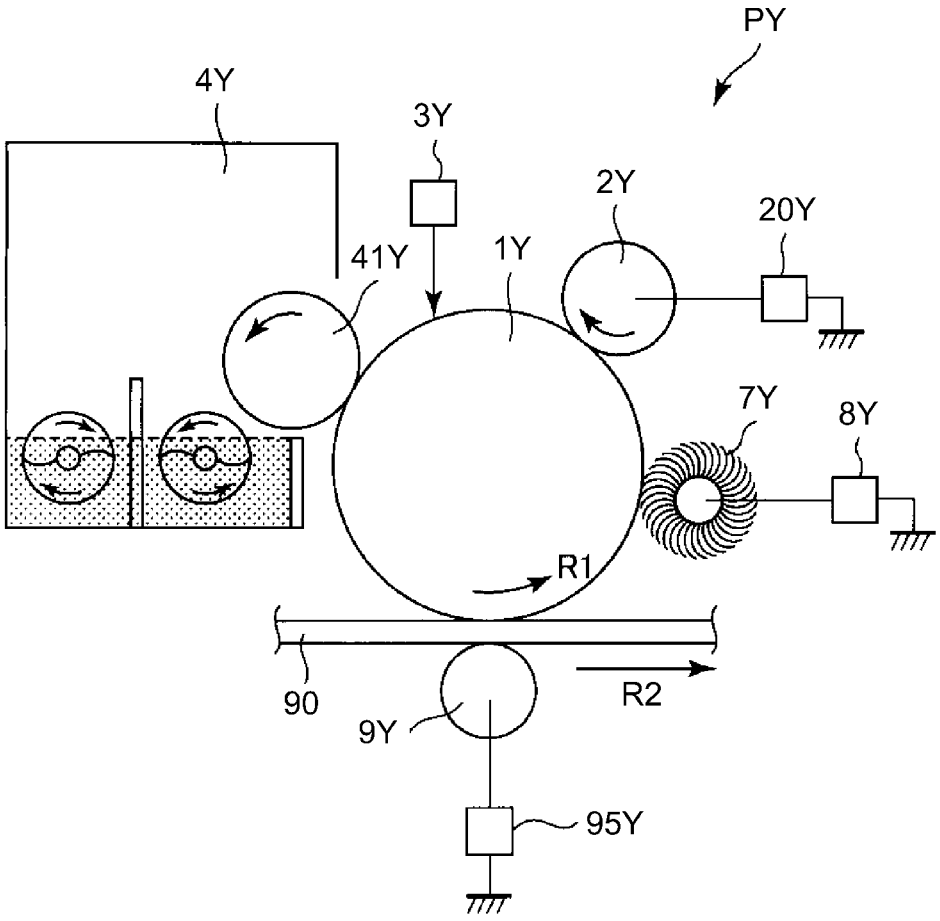
FIG. 2 is a schematic sectional view for illustrating a structure of an image forming portion of the image forming apparatus of FIG. 1.

FIG. 1 shows a general structure of an image forming apparatus in this embodiment. Further, FIG. 2 shows a structure of an image forming portion provided in the image forming apparatus of FIG. 1.

As shown in FIG. 1, an image forming apparatus 100 is an intermediary transfer type full-color printer of a tandem type in which respective image forming portions PY, PM, PC and PK for yellow, magenta, cyan and black as a plurality of image forming portions are arranged along an intermediary transfer belt 90.

At the respective image forming portions PY, PM, PC and PK, toner images for respective colors are formed on photosensitive drums 1Y, 1M, 1C and 1K as photosensitive members rotating in arrow R1 directions shown in the figure at a predetermined process speed (peripheral speed). Then, the respective color toner images formed on the respective photosensitive drums 1Y, 1M, 1C and 1K are primary-transferred onto the intermediary transfer belt 90 at respective primary transfer portions N1Y, N1M, N1C and N1K.

A full-color toner image formed by superposedly primary-transferring the four color toner images is conveyed to a secondary transfer portion N2 with rotation of the intermediary transfer belt 90, and is a secondary-transferred onto a recording material S. The recording material S taken out from a recording material cassette (not shown) is separated one by one by a separation roller (not shown) and is conveyed to a registration roller 12. The registration roller 12 sends the recording material S to the secondary transfer portion N2 by being timed to the toner images on the intermediary transfer belt 90. The recording material S on which the full-color toner image is secondary-transferred at the secondary transfer portion N1 is subjected to heat and pressure application by a fixing device 14, and after an image is fixed on its surface, is discharged to an outside of an apparatus main assembly of the image forming apparatus 100.

The intermediary transfer belt 90 as an intermediary transfer member as a transfer-receiving member is extended around and supported by a driving roller 93, a tension roller 92 and a secondary transfer opposite roller 91, and is driven by the driving roller 93 to rotate in an arrow R2 direction shown in the figure at a predetermined process speed. A secondary transfer roller 11 as a roller-type member as a secondary transfer means is press-contacted to the intermediary transfer belt 90 supported at an inside surface by the secondary transfer opposite roller 91 to form the secondary transfer portion N2.

A belt cleaning device 10 causes a cleaning blade to contact the intermediary transfer belt 90, and removes and collects a transfer residual toner, on the intermediary transfer belt 90, which passed through the secondary transfer portion N2 without being transferred onto the recording material S.

The respective image forming portions PY, PM, PC and PK have the substantially same constitution except that the colors of toners used in developing devices 4Y, 4M, 4C and 4K are different from each other. In the following, the yellow image forming portion PY is described, and with respect to the magenta, cyan and black image forming portions PM, PC and PK are to be described by reading a suffix Y, of symbols added to elements of the yellow image forming portion PY, as M, C and K. Further, in the case where the image forming portions are collectively described with no distinction such that the elements is for any of the image forming portions, the suffixes Y, M, C and K will be omitted.

2. Image Forming Portion

As shown in FIG. 2, at the image forming portion PY, at a periphery of the photosensitive drum 1Y, a charging roller 2Y, an exposure device 3Y, the developing device 4Y, a primary transfer roller 9Y and an auxiliary charging brush 7Y are disposed.

The photosensitive drum 1Y which is a drum-type (rotatable member) photosensitive member as an image bearing member is constituted by forming a photosensitive layer on an outer peripheral surface of an aluminum cylinder.

The charging roller 2Y which is a roller-type (rotatable member) charger as a charging means is rotated in contact with the photosensitive drum 1.

In this embodiment, the charging roller 2 has a three-layer structure in which a lower layer, an intermediary layer and a surface (skin) layer are laminated successively from below around a core metal formed of metal. The lower layer is a foam sponge layer for reducing charging nose, and the surface layer is a protective layer provided for suppressing flow of a leak current even when there is a portion, such as a pin hole, where a film thickness is thin. More specifically, as the core metal, a stainless steel round bar can be used. Further, as the lower layer, it is possible to use a foam rubber (EPDM or the like) in which carbon black is dispersed to adjust a volume resistivity at about $10^2$-$10^9$ Ωcm. Further, as the intermediary layer, it is possible to use a rubber (NBR-based rubber or the like) in which carbon black is dispersed to adjust the volume resistivity at about $10^2$-$10^5$ Ωcm. Further, as the surface layer, it is possible to use the protective layer in which tin oxide and carbon black are dispersed in a resin material of a fluorine compound to adjust the volume resistivity at about $10^7$-$10^{10}$ Ωcm. Alternatively, as the charging roller 2, one including an elastic layer formed of an ion conductive material such as epichlorohydrin rubber may also be used.

The charging roller 2 is surged in a center direction of the photosensitive drum 1 by an urging spring as an urging means, and is press-contacted to the surface of the photosensitive drum 1 at a predetermined urging force.

Further, to the charging roller 2, a charging voltage (charging bias) which is an oscillating voltage including a DC voltage (charging DC voltage) and an AC voltage (charging AC voltage) which are superimposed is applied from a charging high voltage source 20Y. As a result, the charging roller 2Y electrically charges the surface of the photosensitive drum 1Y to a uniformly negative-polarity dark portion potential VD. A value of a peak-to-peak voltage Vpp of the charging AC voltage may desirably be set a voltage which is two times (twice) a discharge start voltage Vth, described later, which is in accordance with Paschen's law determined from electrostatic capacity or the like of the photosensitive drum 1. By applying a proper charging AC voltage, a surface potential of the photosensitive drum 1 substantially converges to a potential of the charging DC voltage.

The exposure device (laser scanner) 3Y as an exposure means writes an electrostatic image (electrostatic latent image) on the charged photosensitive drum 1Y by scanning the photosensitive drum 1Y, through a rotating mirror, with a laser beam obtained by subjecting an image signal, developed from a yellow image, to ON/OFF modulation. At an exposed portion, the dark portion potential VD is lowered by a light portion potential VL by electric discharge.

The developing device 4Y as a developing means develops the electrostatic latent image (electrostatic image), formed on the photosensitive drum 1Y, with a developer containing a toner and a carrier, so that a yellow toner image is formed on the photosensitive drum 1Y. In this embodiment, the developing device 4Y uses, as the developer, a two-component developer provided with the toner (non-magnetic toner particles) and the carrier (magnetic carrier particles). The developing device 4Y includes a rotatable developing sleeve 41Y as a developer carrying member so that a part of the developing sleeve 41Y is exposed from an opening, opposing the photosensitive drum 1Y, of a developing container for accommodating the developer. The developer is carried on this developing sleeve 41Y and is fed to a developing portion as an opposing portion to the photosensitive drum 1Y, so that the toner in the developer is supplied onto the photosensitive drum 1Y. To the developing sleeve 41Y, from a developing high voltage source (not shown) as a developing high-voltage applying means, a developing voltage (developing bias) which is an oscillating voltage including a DC voltage (developing DC voltage) and an AC voltage (developing AC voltage) which are superimposed is applied. In this embodiment, the toner image is formed by a combination of image exposure with reversal development. That is, the electrostatic latent image is developed by depositing the toner, charged to the same polarity (normal charge polarity) as a charge polarity (negative in this embodiment) of the photosensitive drum 1Y, on the exposed portion where an absolute value of the potential is lowered by the exposure to light after the photosensitive drum 1Y is uniformly charged.

The primary transfer roller 9 which is a transfer member of a roller type as a primary transfer means urges an inside surface of the intermediary transfer belt 90 to press-contact the photosensitive drum 1Y and the intermediary transfer belt 90 to each other to form a primary transfer portion N1Y. To the primary transfer roller 9Y, from a transfer high voltage source 95Y as a transfer voltage applying means, a transfer voltage (transfer bias) which is a DC voltage (transfer DC voltage) of an opposite polarity to the normal charge polarity of the toner is applied. As a result, the negative toner image carried on the photosensitive drum 1Y is primary-transferred onto the intermediary transfer belt 90. In this embodiment, a transfer current during normal image formation was set at 20 μA.

The auxiliary charging brush 7Y as an auxiliary charging member (toner charging means) electrically charges a transfer residual toner, passing through the primary transfer portion N1Y without being transferred onto the intermediary transfer belt 90, to a negative uniform potential while diffusing the transfer residual toner to the surface of the photosensitive drum 1Y. To the auxiliary charging brush 7Y, from an auxiliary charging high voltage source 8Y as an auxiliary charging voltage applying means, an auxiliary charging voltage (auxiliary charging bias) which is a discharge current voltage (auxiliary charging discharge current voltage) of the same polarity as the normal charge polarity of the toner is applied. The transfer residual toner reaches the developing device 4Y without being deposited on the charging roller 2Y by being charged to the uniform negative potential. Then, it becomes possible to collect and reuse the toner residual toner in the developing device 4Y. In this way, a system in which the transfer residual toner is reused in the developing device without being collected by the cleaning blade or the like is referred to as a "cleaner-less system".

Incidentally, at each of the image forming portions, the photosensitive member and at least one of process means acting on the photosensitive member integrally constitute a process cartridge, and may be detachably mountable to an apparatus main assembly of the image forming apparatus. As the process means, the charging means, the developing means, the cleaning means and the like may be cited. Further, in the case of the cleaner-less system, a toner charging means or a photosensitive member charge-removing means may also be integrally included in the process cartridge.

3. Discharge Current Control

3-1. Control Example

Figure 3:
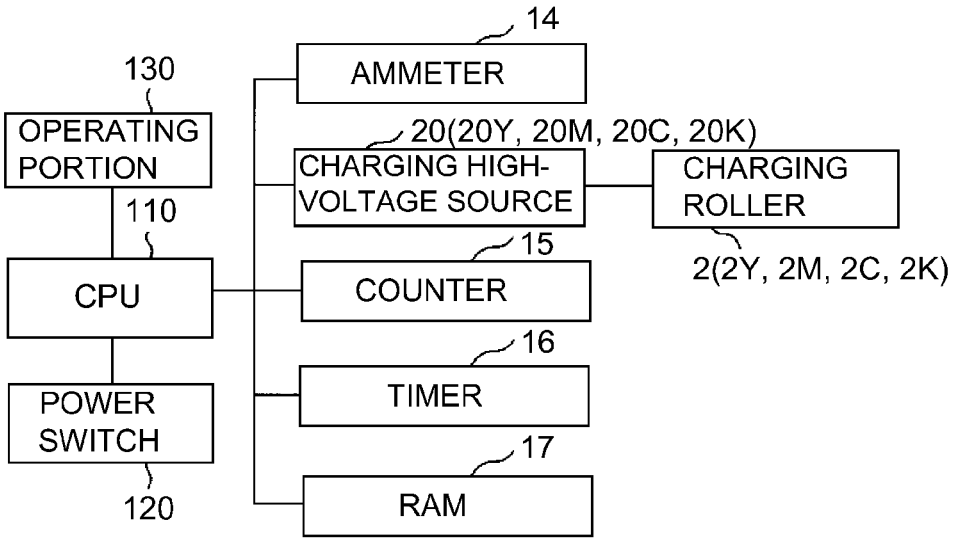
FIG. 3 is a block diagram showing a control example of a principal part of the image forming apparatus according to the embodiment of the present invention.

FIG. 3 shows a schematic control example of a principal part of the image forming apparatus 100 in this embodiment. An operation of the image forming apparatus 100 is controlled by CPU 110 as a current means in a centralized manner. The CPU 110 controls of the respective portions of the image forming apparatus 100 in accordance with programs and data stored in a storing means (such as an electronic memory) incorporated in or connected with the CPU 110.

For example, in relation to this embodiment, to the CPU 110, a power switch 120 which is a hard switch, an operating portion 130, a charging high voltage source 20 as a bias applying device, and the like are connected. Further, to the CPU 110, an ammeter 14 as a detector (current detecting portion), a counter 15 as a use amount detecting means (sheet number measuring portion), a timer 16 as a time measuring means (time measuring portion) and RAM 17 as a storing means (memory portion) are connected. The ammeter 14, counter 15, timer 16 and RAM 17 are used in discharge current control and the like described later. The ammeter 14 inputs information about a detected AC current value. Further, the charging high voltage source 20 has the function of a voltage detecting means for detecting a peak-to-peak voltage of the AC voltage to be outputted, and is capable of inputting the information, about the peak-to-peak voltage of the AC voltage, into the CPU 110. Further, the counter 15 and the timer 16 input, into the CPU 110, information about a counted result of the number of sheets of image formation and information about a measured result of a time, respectively. Further, the CPU 110 can store the above-described respective detection results in the RAM 17 and can read the results from the RAM 17 as needed.

3-2. Principle of Discharge Current Control

Here, a principle of the discharge current control will be described.

A discharge start voltage to the photosensitive member when a DC voltage is applied to the charging member is Vth.

Figure 9:
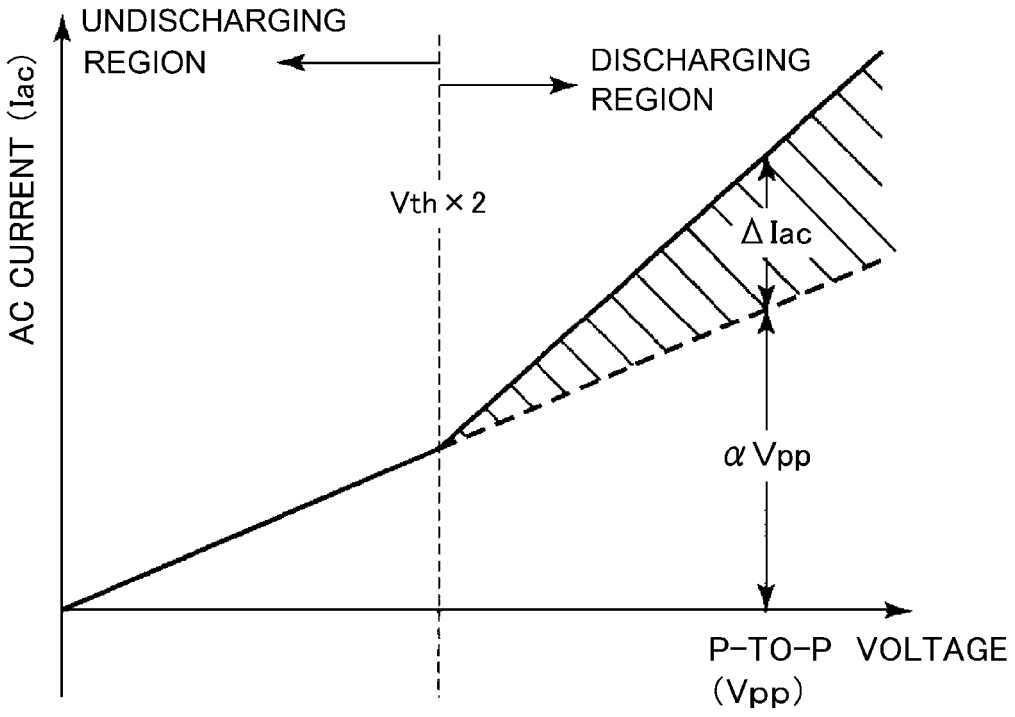
FIG. 9 is an illustration of a definition of a discharge current.

As shown in FIG. 9, a charging AC current Iac flowing by the application of the charging AC voltage has a linear relationship in an undischarging region in which the voltage is less than twice the discharging start voltage (Vthx2). Here, the peak-to-peak voltage which is twice the discharge start voltage not less than Vthx2 is also referred to as a "discharge start point". Further, in the discharging region not less than Vthx2, the charging AC current Iac gradually offsets from a rectilinear line toward an increasing direction with increase of the peak-to-peak voltage Vpp of the charging AC voltage. In similar experiments in vacuum in which no discharge occurs, the linearity is maintained, and therefore, it would be considered that the offset is an increment ΔIac of the current contributing to the discharge.

Here, a ratio of the charging AC current Iac relative to the peak-to-peak voltage Vpp of the charging AC voltage in the undischarging region less than Vthx2 is α. At this time, the AC current flowing to the contact portion between the photosensitive member and the charging member (hereinafter, also referred to as a "nip current") except for the discharge current at the discharging region not less than Vthx is α.Vpp is defined as a "discharging current amount" representing, as a substitute for, the discharging amount provided by the application of the charging AC voltage:

$$\Delta Iac = Iac - \alpha . Vpp \qquad \text{formula 1.}$$

In the discharge current control, when a desired discharge current amount is D, the peak-to-peak voltage of the charging AC voltage providing this discharge current amount D is regulated (adjusted) by the CPU 110 as a regulator (adjuster).

Incidentally, the CPU 110 executes, during non-image formation, computation and determination program of a proper peak-to-peak voltage value of the charging AC voltage to the charging roller 2 in a charging step during the image formation. As during the non-image formation, the following can be cited. There are during power-on which is the time when a power switch (hard switch) of the image forming apparatus is turned on (pressed down) and during an initial rotation operation (pre-multi-rotation step), such as during restoration from a sleep mode in which the image forming apparatus is left standing for a predetermined time from last image formation, in which a predetermined preparatory operation for raising a fixing temperature or the like is executed. Further, there is during a print preparation rotation operation (pre-rotation step) in which a predetermined preparatory operation is executed in a period from input of an image forming signal until an image depending on image information is actually written out. Further, there is during a sheet interval step corresponding to an interval between transfer materials during continuous image formation. Further, there is a post-rotation step in which a predetermined processing operation (preparatory operation) is executed after the image formation is ended. Timing of start of the image formation is timing when the information depending on the image information is actually written out after the image forming signal is inputted.

Figure 10:
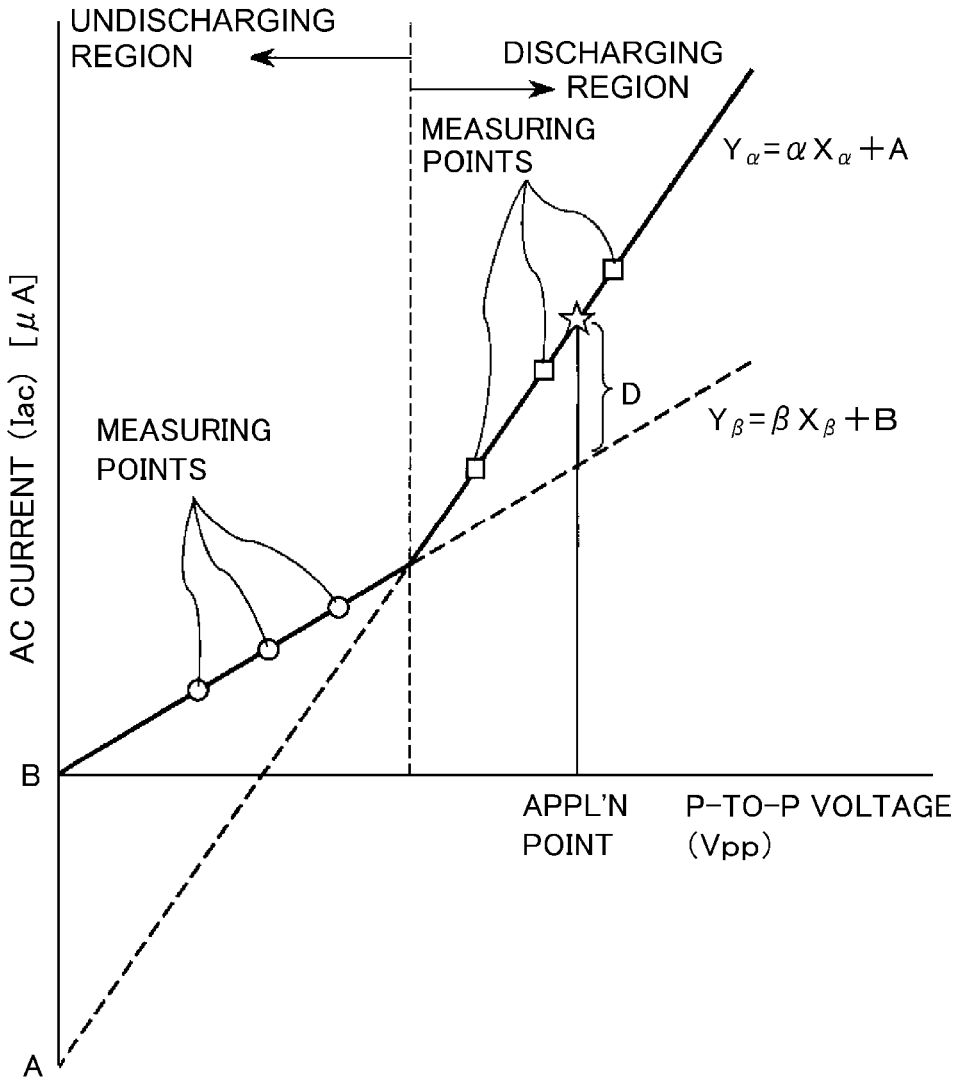
FIG. 10 is an illustration for illustrating a principle of an example of the discharge current control.

First, as shown in FIG. 10, the CPU 110 controls the charging HVS 20 to apply sequentially, to the charging roller 2, three peak-to-peak voltages Vpp in the discharging region and three peak-to-peak voltages Vpp in the undischarging region, as the charging AC voltages. When the respective peak-to-peak voltages are applied, values of the AC currents Iac flowing into the charging rollers 2 are measured by the ammeter 14, and are inputted to the CPU 110.

Figure 11:
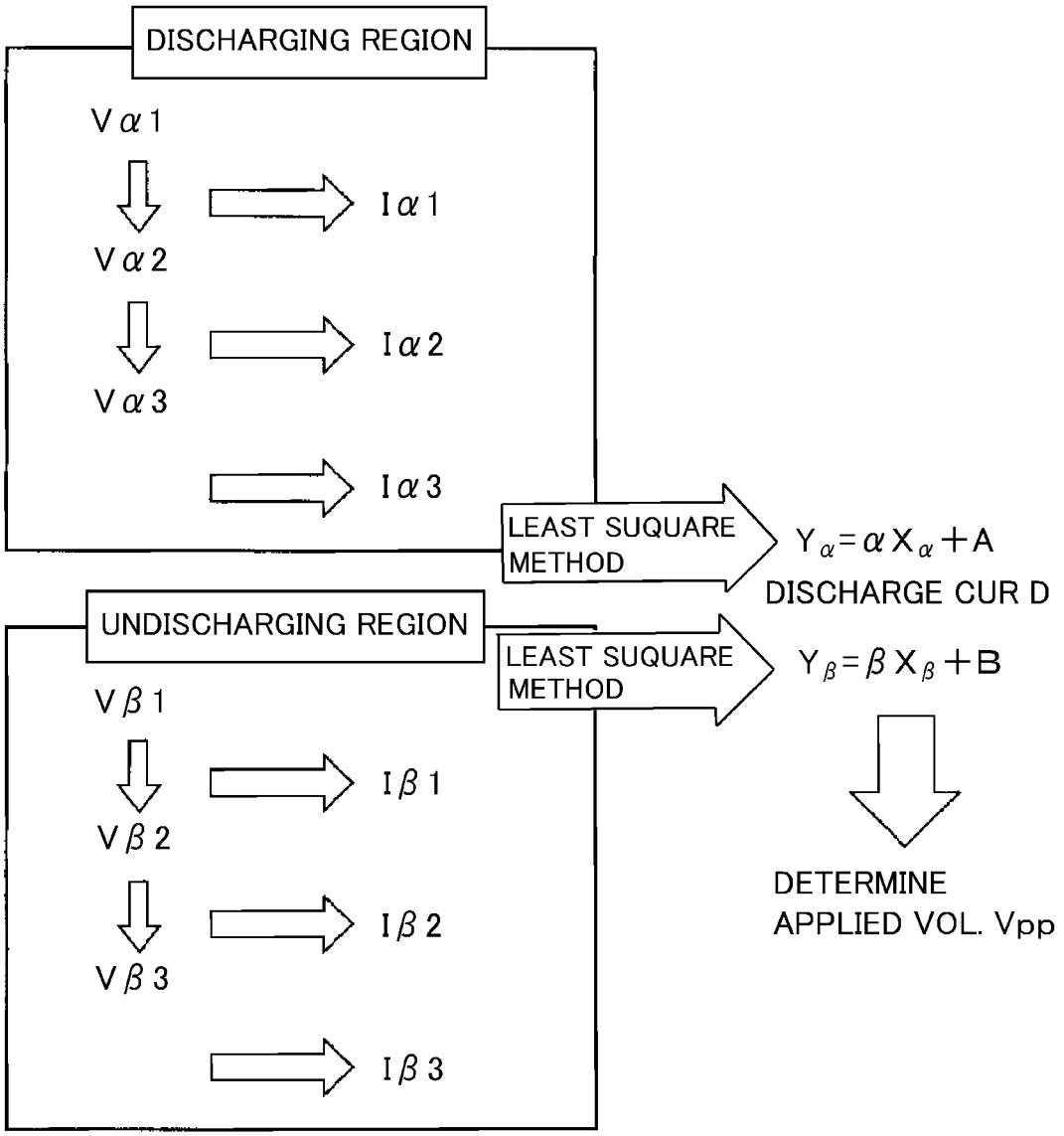
FIG. 11 is an illustration for illustrating the principle of the example of the discharge current control.

Then, as shown in FIG. 11, the CPU 110 effects a linear approximation of the relation between the peak-to-peak voltage of the charging AC voltage and the charging AC current, in each of the discharging region and the undischarging region, using a least square approximation from the three measured currents in each of the discharging region and undischarging region, thus calculating the following formulas 2 and 3:

Approximated line for the predetermined:

$$V\alpha = \alpha \times \alpha + A \qquad \text{formula 2}$$

Approximated line for the undischarging region:

$$Y\beta = \beta \times \beta + B \qquad \text{formula 3}$$

Thereafter, the CPU 110 determines the peak-to-peak voltage Vpp of the charging AC voltage with which the difference between the approximated line for the discharging region of the formula 2 and the approximated line for the undischarging region of the formula 3 is the discharge current amount D, by the following formula 4.

$$Vpp = (D - A + B)/(\alpha - \beta) \qquad \text{formula 4}$$

Here, the formula 4 is derived as follows: Since the difference between the approximated line for the discharging region of the formula 2 and the approximated line for the undischarging region of the formula 3 is D.

$$Y\alpha - Y\beta = (\alpha \times \alpha + A) - (\beta \times \beta + B) = D.$$

Now, a value of X providing D is sought, and when a point thereof is Vpp, $$(\alpha Vpp + A) - (\beta Vpp + B) = D.$$

Therefore, $$Vpp = (D - A + B)/(\alpha - \beta).$$

Then, during the image formation, the CPU 110 switches the peak-to-peak voltage Vpp of the charging AC voltage, applied to the charging roller 2, to the value obtained, by the formula 4, with which the constant-voltage-control is carried out.

Incidentally, in the above, the approximated lines were obtained from the data of the charging AC voltage at three points and the charging AC currents at three points in the discharging region and the undischarging region, respectively. However, as will be apparent by one skilled in the art, the approximated line can be determined from the data at at least two points in the discharging region. In the undischarging region, the approximated line can be determined from the data at the zero point and at least one point (Yβ=β×β in this case).

Further, in the above, with respect to a necessary discharge current amount, the method in which the peak-to-peak voltage of a necessary charging AC voltage is calculated and the constant-voltage-control is carried out at the charging AC voltage value was described. In this embodiment, this method is used. On the other hand, with respect to the necessary discharge current amount, it is also possible to carry out constant-current-control, in which a necessary charging AC current value is calculated, at that charging AC current value. A principle of the control in this case will be described below.

Figure 12:
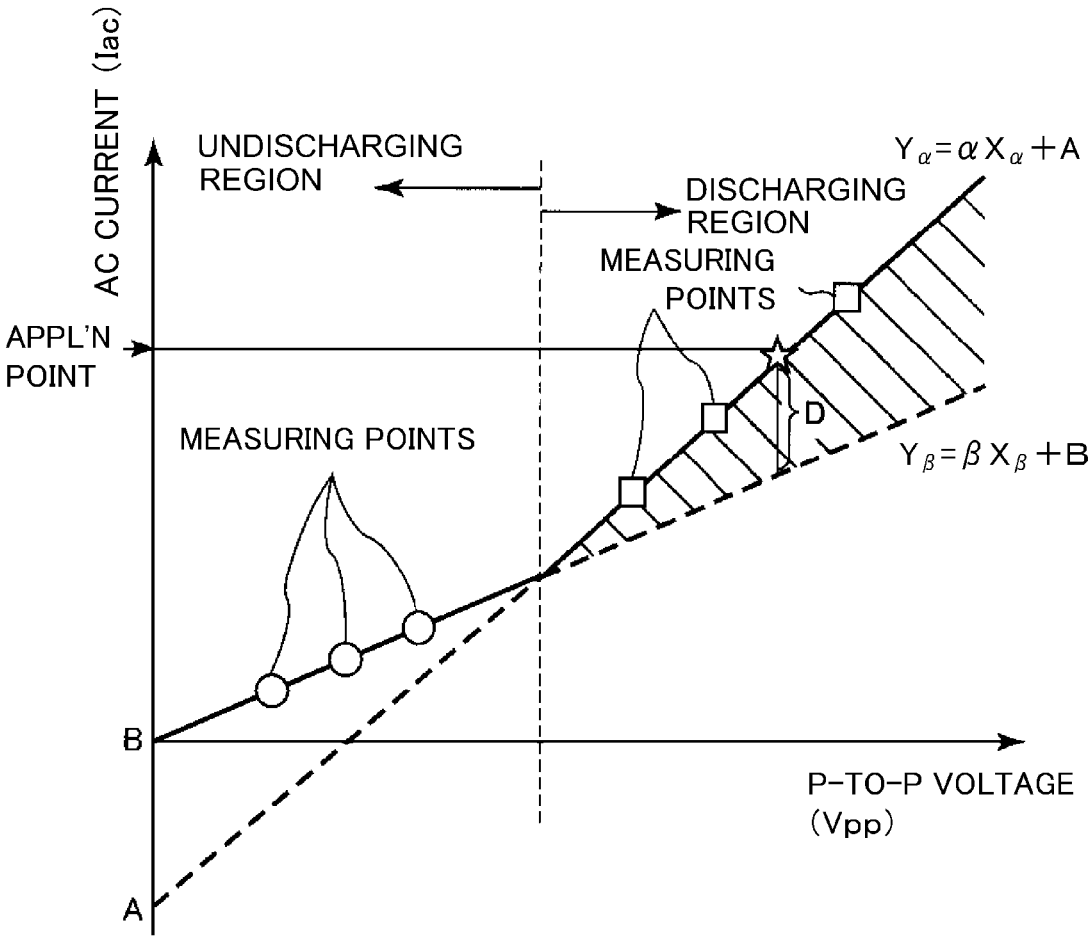
FIG. 12 is an illustration for illustrating a principle of another example of the discharge current control.

First, as shown in FIG. 12, the CPU 110 controls the charging high voltage source 20 to apply sequentially, to the charging roller 2, three AC currents Iac in the discharging region and three AC currents in the undischarging region, as the charging AC currents. Then, when the respective charging AC currents are obtained by a current detecting device 120, the peak-to-peak voltages of the charging AC voltage outputted by the charging high voltage source 20 are measured.

Figure 13:
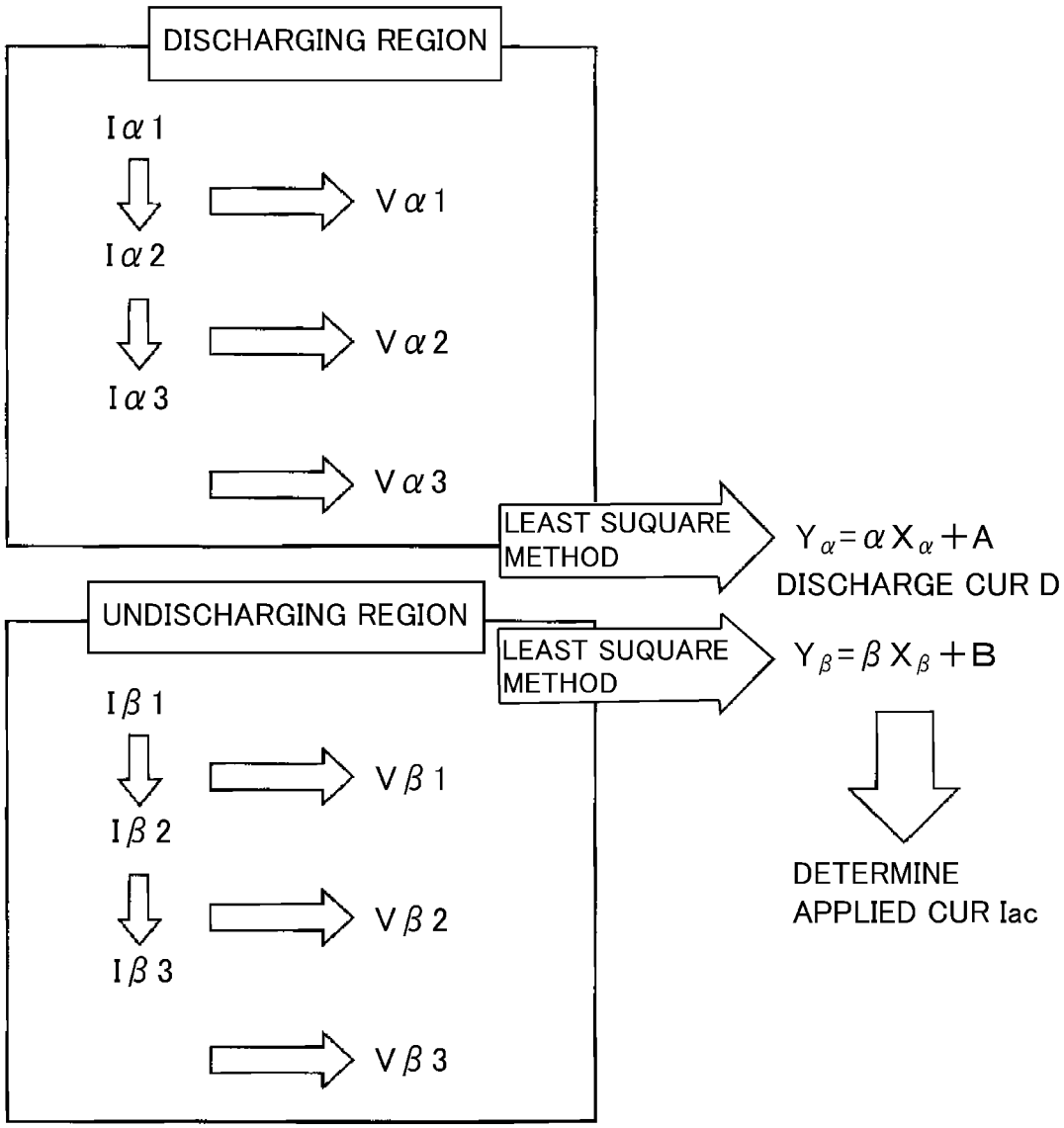
FIG. 13 is an illustration for illustrating a principle of another example of the discharge current control.

Then, as shown in FIG. 13, the CPU 110 effects a linear approximation of the relation between the peak-to-peak voltage of the charging AC voltage and the charging AC current, in each of the discharging region and the undischarging region, using a least square approximation from the three measured voltages in each of the discharging region and undischarging region, thus calculating the following formulas 2 and 3:

Approximated line for the discharging region:

$$V\alpha=\alpha\times\alpha+A \quad \text{formula 2}$$

Approximated line for the undischarging region:

$$V\beta=\beta\times\beta+B \quad \text{formula 3}$$

Therefore, the CPU 110 determines the peak-to-peak voltage Vpp of the charging AC current value Iac with which the difference between the approximated line Yα for the discharging region of the formula 2 and the approximated line Yβ for the undischarging region of the formula 3 is the discharge current amount D, by the following formula 8.

That is, when the charging AC current value with which the difference is discharge current value D is Iac1, and a peak-to-peak voltage of a charging AC voltage at that time is Vpp, then the above formulas 2 and 3 are, $$Iac1=\alpha Vpp+A \quad \text{formula 5}$$

$$Iac2=Vpp+B \quad \text{formula 6.}$$

Here, Iac2 is an AC current value providing Vpp in the approximated line Yβ in the undischarging region. In addition, the following formula 7 holds:

$$Iac1=Iac2+D \quad \text{formula 7.}$$

Accordingly, the formulas 5, 6 and 7, the charging AC current value Iac with which the difference is the discharge current amount D is determined by the following formula 8.

$$Iac1=(\alpha D+\alpha B-\beta A)/(\alpha-\beta) \quad \text{formula 8}$$

During the image formation, the CPU 110 switches the value of the charging AC current flowing into the charging roller 2 so as to be the value obtained by the above formula 8, thus carrying out the constant-current-control.

Incidentally, in the above, the approximated lines were obtained from the data of the charging AC voltages at three points and the charging AC currents at three points in the discharging region and the undischarging region, respectively. However, as will be apparent by one skilled in the art, the approximated line can be determined from the data at at least two points in the discharging region. In the undischarging region, the approximated line can be determined from the data at the zero point and at least one point (Yβ=β×β in this case).

3-3. Specific Example of Discharge Current Control in this Embodiment

Figure 4:
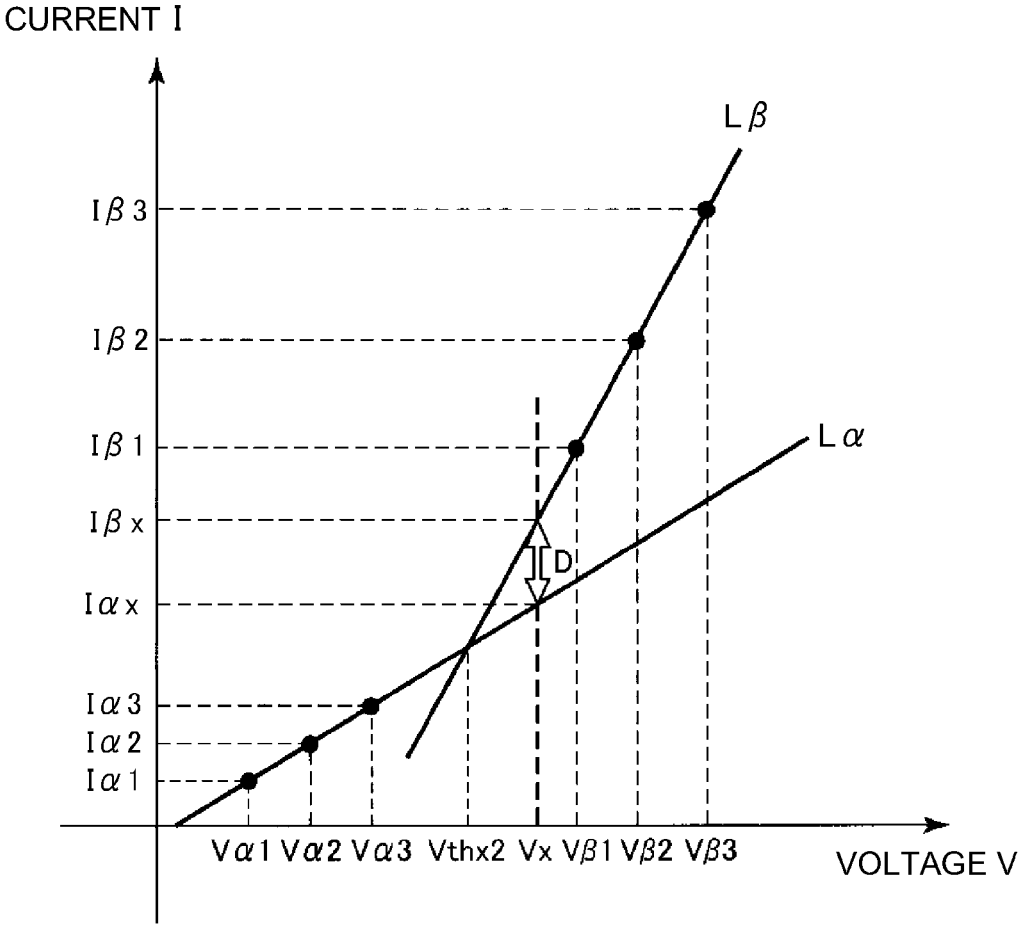
FIG. 4 is a graph for illustrating an outline of discharge current control in the embodiment of the present invention.

FIG. 4 shows an outline of the discharge current control in this embodiment. The discharge current control is carried out in a state in which the photosensitive drum 1 is driven. Incidentally, in this embodiment, the discharge current control is carried out at the image forming portions PY, PM, PC and PK for all the colors, but the discharge current control itself effected at each of the image forming portions is the same, and therefore attention is paid to a single image forming portion and description will be made.

As shown in FIG. 4, the CPU 110 as a regulator (adjuster) applies AC voltages vα1, Vα2, Vα3, which are test biases in the undischarging region, from the charging high voltage source 20 to the charging roller 2. Further, the CPU 110 detects AC currents Iα1, Iα2 and Iα3 flowing between the charging roller 2 and the photosensitive drum 1 at that time by the ammeter 14 which is the detector. That is, the ammeter 14 detects the AC currents in the above undischarging region and sends signals relating to detected results to the CPU 110. Then, the CPU 110 calculates a rectilinear approximated line Lα from the three AC voltages Vα and the three AC currents Iα.

Further, the CPU 110 applies AC voltages Vβ1, Vβ2, Vβ3, which are test biases in the discharging region, from the charging high voltage source 20 to the charging roller 2. Further, the CPU 110 detects AC currents Iβ1, Iβ2 and Iβ3 flowing between the charging roller 2 and the photosensitive drum 1 at that time by the ammeter 14. That is, the ammeter 14 detects the AC currents in the above discharging region and sends signals relating to detected results to the CPU 110. Then, the CPU 110 calculates a rectilinear approximated line Lβ from the three AC voltages Vα and the three AC currents Iβ.

Here, a voltage V where Lα and Lβ cross with each other is called the discharge start point (substantially twice the discharge start voltage Vth).

As described above, in the discharge current control, at a specific AC voltage Vx, a difference an AC current Iαx on the rectilinear approximated line Lα and an AC current Iβx on the rectilinear approximated line Lβ is defined as a discharge current amount D (Iβc−Iαx). Further, the CPU 110 obtains a peak-to-peak voltage value (charging AC voltage value) Vx of the charging AC voltage during the image formation so that this D is always constant.

The discharge current control as described above in this embodiment is called particularly full control (test mode) of the discharge current control in order to distinguish it from simple control (check mode) described later.

In this embodiment, Vα1=800 Vpp, Vα2=900 Vpp and Vα3=1000 Vpp were set. Further, at this time, Iα1=474 μA, Iα2=532 μA and Iα3=592 μA are detected, respectively. Further, in this embodiment, Vβ1=1500 Vpp, Vβ2=1600 Vpp and Vβ3=1700 Vpp were set. Further, at this time, Iβ1=942 μA, Iβ2=1051 μA and Iβ3=1167 μA are detected, respectively. Further, in this embodiment, the discharge current amount D is controlled at a constant value of 30 μA. In this case, according to the above-mentioned AC current detection results, Vx=1300 Vpp is determined.

In this embodiment, all the relations between the AC voltages and the AC currents detected in the discharge current control as described above and the charging AC voltage values obtained by the discharge current control are stored in the RAM 17. Then, these values are overwritten when the full control of the discharge current control is carried out in the next time.

The CPU 110 causes the charging high voltage source 20 to apply the voltage, after determining this AC charging voltage value Vx=1300 Vpp, for a period corresponding to one-full-circumference of the photosensitive drum 1 in order to eliminate potential non-uniformity by the control, and ends the image formation preparation.

By carrying out the full control of the discharge current control for determining the value of the charging AC voltage to be applied to the charging roller 2 as described above, it is possible to suppress image flow on the photosensitive drum 1 due to an excessive current and image defect due to charging non-uniformity of the photosensitive member resulting from contamination non-uniformity of the charging roller 2. Further, when the discharge current amount is excessively small, there is the case where the image defect due to the charging non-uniformity of the photosensitive member occurs, but by carrying out the full control of the discharge current control as described above, a proper discharge current amount can be maintained.

In the above-described example, the case where in the test mode, the discharge current control in which values of the currents flowing into the charger when the plurality of test biases different in peak-to-peak voltage from each other are applied are detected and the peak-to-peak voltage of the charging bias is set on the basis of the detection results is carried out until the time of the setting is described, but in the test mode, the discharge current control may also be not required to be carried out until the time of the setting of the peak-to-peak voltage of the charging bias, and for example, the peak-to-peak voltage of the charging bias may also be set immediately before the image formation.

Incidentally, in the cleaner-less system, when a cleaning sequence for the charging roller 2 is added before the full control of the discharge current control is carried out, accuracy of the discharge current control is further improved.

4. Operation Start Control of Discharge Current Control

Next, operation start control of the discharge current control will be described.

In the case where a power source is turned on by the turning-on of the power switch 120 which is the hard switch of the image forming apparatus, there is possibility that the charging roller 2 is contaminated with the toner or an external additive by the image formation before the power switch is turned off or a possibility that an environment is changed during a period in which the power switch is turned off, and therefore the full control of the discharge current control is carried out. Accordingly, in this embodiment, in the case where the power switch 120 of the image forming apparatus 100 is turned on, the signal is sent to the CPU 110, and the discharge current control is carried out during the pre-multi-rotation operation which is the image formation preparatory operation (flow is not shown).

Further, when the image formation is effected in a period from the turning-on of the power switch 120 until the power switch 120 is turned off, an electric resistance of the charging roller 2 is changed by temperature rise, and therefore the full control of the discharge current control is carried out periodically. Accordingly, in this embodiment, in the case where image formation of a predetermined sheet number is effected in the state in which the power switch 120 is turned on, the full control of the discharge current control is carried out (details will be described later with reference to a flow).

Further, also in the case where the image forming apparatus is used after being left standing for a long term without being used in the state in which the power switch 120 is turned on, the full control of the discharge current control is effected. This is because the temperature of the charging roller 2 increased by the image formation is decreased, and therefore the change in electric resistances of the charging roller 2 is generated. Accordingly, in this embodiment, in the case where the image forming apparatus is left standing for a long term in the state in which the power switch 120 is turned on, the full control of the discharge current control is carried out (details will be described later with reference to a flow).

Figure 5:
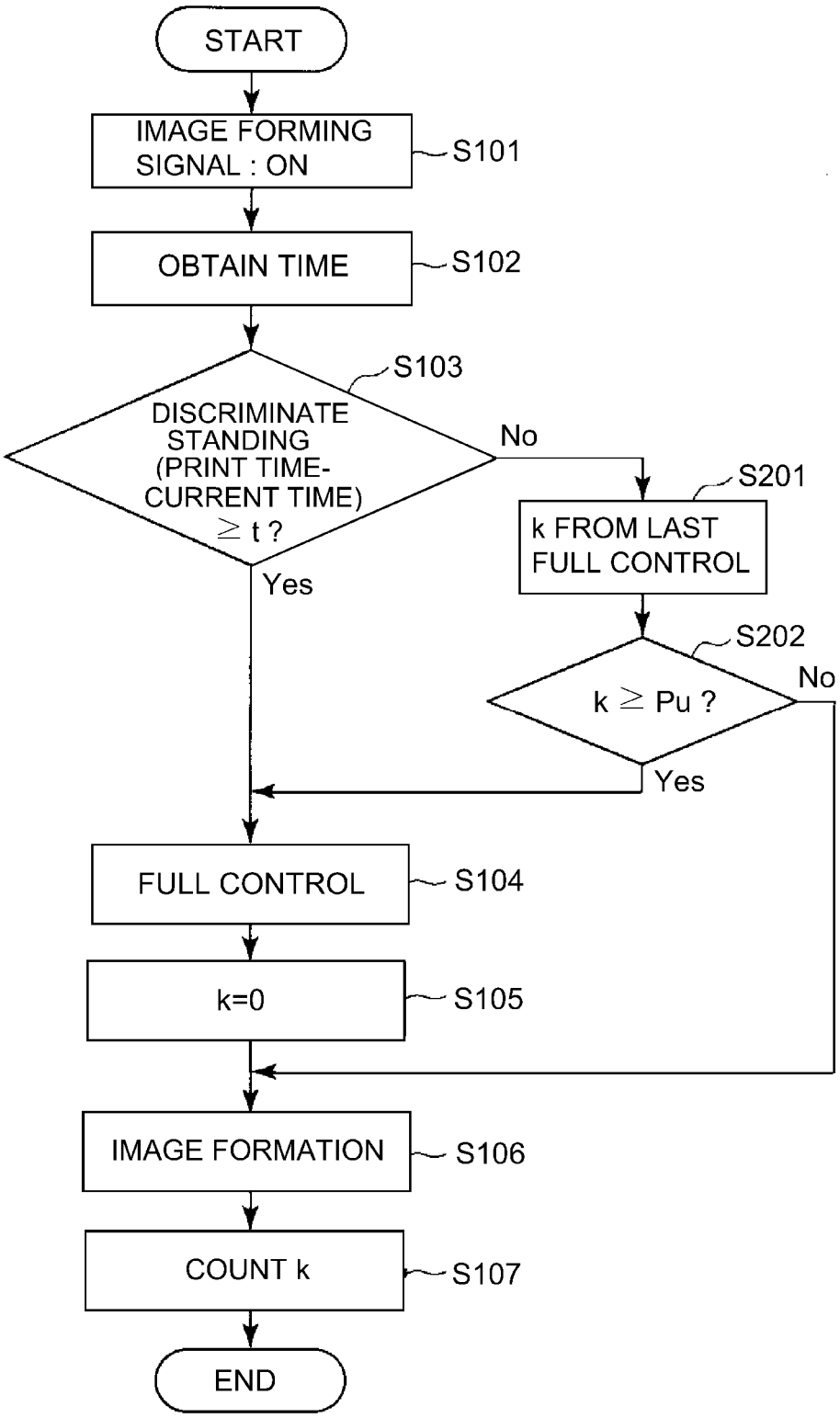
FIG. 5 is a flowchart for illustrating operation start control of full control of the discharge current control in the embodiment of the present invention.

FIG. 5 is a flowchart of an example of control (operation start control) for discriminating whether or not the full control of the discharge current control in this embodiment is carried out. Here, control for discriminating timing when the full control of the discharge current control is carried out in the state in which the power switch 120 is turned on will be described.

First, an image forming signal (image formation start instruction) is sent from the operating portion 130 of the image forming apparatus 100 to the CPU 110 (S101).

Next, the CPU 110 reads a current time from the timer 16, and stores the time in the RAM 17 (S102).

Then, the CPU 110 makes standing discrimination (S103). In the standing discrimination, the following discrimination is made. That is, the CPU 110 stores, in the RAM 17, the time when last image formation is effected, and compares the time with last time when a subsequent image forming signal is sent, thus checking whether or not a predetermined time (hereinafter referred to as a "control switching time") t or more elapses. The CPU 110 discriminates that the apparatus main assembly of the image forming apparatus 100 is after being left standing in the case where the control switching time t or more elapses. By using this method, it is possible to suppress power consumption due to always continuous counting of time. However, as desired, the time may also be always counted, and it may only be required that whether or not the image forming apparatus is left standing for a predetermined time or more without performing the image forming operation can be discriminated. In this embodiment, control switching time t=8 hours was determined from a time enough to cool the charging roller 2 after the temperature of the charging roller 2 is increased by the image formation.

The CPU 110 carried out the full control of the discharge current control in the case where the CPU 110 discriminates that the image forming apparatus is after being left standing in S103 (S104). Incidentally, in this embodiment, even in the case where the image forming apparatus is discriminated as being after being left standing, simple control of the discharge current control is carried out in some cases, but this point will be described later.

In the case where the CPU 110 discriminates that the image forming apparatus is not after being left standing in S103, the CPU 110 reads, from the counter 16, an image formation sheet number (hereinafter referred to as an "intraday sheet number") k from the full control of the last discharge current control until now (S201). The counter 16 counts the image formation sheet number by converting the image formation sheet number into a sheet number (number of sheets) of the recording material S having a predetermined size (e.g., long edge feeding of A4 size (feeding of the recording material in a short direction)). In this embodiment, the full control of the discharge current control is carried out periodically. In this embodiment, a threshold corresponding to an interval in which the full control of the discharge current control is carried out was determined as a predetermined sheet number count value (hereinafter referred to as a "control execution sheet number") Pu=100 sheets of the counter 16. This is determined in consideration of a degree of the change in electric resistance of the charging roller 2, and a constitution in this embodiment, there is the case where the discharge current is set again in order to prevent the above-described image defect when the charging roller 2 is used for image formation of 100 sheets.

Incidentally, in this embodiment, the image formation sheet number is used as a discrimination reference for discriminating whether or not the full control of the discharge current control is carried out, but the present invention is limited thereto. For example, an application time of the charging voltage to the charging roller 2, a rotation time or rotation number of the charging roller 2 or a rotation time or rotation number of the photosensitive drum 1, or the like may also be used as the discrimination reference. That is, as the threshold for discriminating whether or not the full control of the discharge current control is carried out, it is possible to arbitrarily utilize information (parameter) correlated with a use amount of the charging roller 2.

Next, the CPU 110 compares the intraday sheet number k with the control execution sheet number Pu, and checks whether or not the intraday sheet number k is not less than the control execution sheet number Pu (S202).

The CPU 110 executes the full control of the discharge current control in the case where the CPU 110 discriminates that the intraday sheet number k is not less than the control execution sheet number Pu in S202 (S104). This is because it would be considered that an electric resistance change of the charging roller 2 occurs by the temperature rise and contamination of the charging roller 2. In this embodiment, in the case where it is discriminated that the intraday sheet number k is not less than the control execution sheet number Pu the full control of the discharge current control is always carried out.

The CPU 110 makes the intraday sheet number k zero by the counter 15 in the case where the full control of the discharge current control is effected (S105). Thereafter, the CPU 110 causes the image forming apparatus to perform the image forming operation (S106). In the image forming operation, the charging AC voltage to be applied to the charging roller 2 is set at the charging AC voltage value Vx=1300 Vpp determined by the full control of the discharge current control. Further, the CPU 110 causes the counter 15 to count the sheet number, corresponding to sheets subjected to the image formation in the image forming operation, by adding up the sheet number to the intraday sheet number k by the counter 15 (S107).

The CPU 110 causes the image forming apparatus not to carry out the full control of the discharge current control but to perform the image forming operation in the case where the CPU 110 discriminates that the intraday sheet number k is less than the control execution sheet number Pu in S202. This is because there is no need to carry out the full control of the discharge current control.

5. Simple Control

As described above, in the case of conventional discharge current control, e.g., in the case of a user who is extremely low in image formation sheet number in a day, compared with a time in which the image forming operation is performed, there was the case where an energization time and discharge time became long thereby to shorten a lifetime of the charging roller. This is because when the timing is during the turning-on of the power switch or after the standing, the full control of the discharge current control was carried out irrespective of the use amount of the charging roller. Further, there is also the case where the photosensitive member deteriorates due to excessive execution of the full control of the discharge current control although a frequency of the use of the image forming apparatus is low.

In this way, in the case where the intraday sheet number k is small, even when in a state in which a change in environment, such as an office, in which the image forming apparatus is disposed, the power switch 120 is turned off and thereafter is turned on again or the image forming apparatus is left standing for a predetermined time or more in a state in which the power switch 120 is turned on, the electric resistance change of the charging roller is small. This is because the electric resistance change due to the temperature rise and the contamination is small since the change in environment is small and an actual use amount of the charging roller 2 is small. For that reason, typically, a set voltage of the charging AC voltage by the full control of the discharge current control when the timing is discriminated as being during the turning on of the power switch 120 carried out every day or after the standing is little changed. For that reason, in this way, by the execution of the full control of the discharge current control, of which necessity is actually low, the charging roller 2 deteriorates by energization.

Therefore, in this embodiment, as described above, in the case of a manner of use such that the intraday sheet number k is less than the predetermined sheet number, the CPU 110 executes the simple control which is a check mode, and the CPU 110 selects and executes, on the basis of a result of the simple control, one from a plurality of modes including a first mode in which the charging bias is set by carrying out the full control which is a test mode and a second mode in which the charging bias regulated through last full control without carrying out the full control is set.

Figure 6:
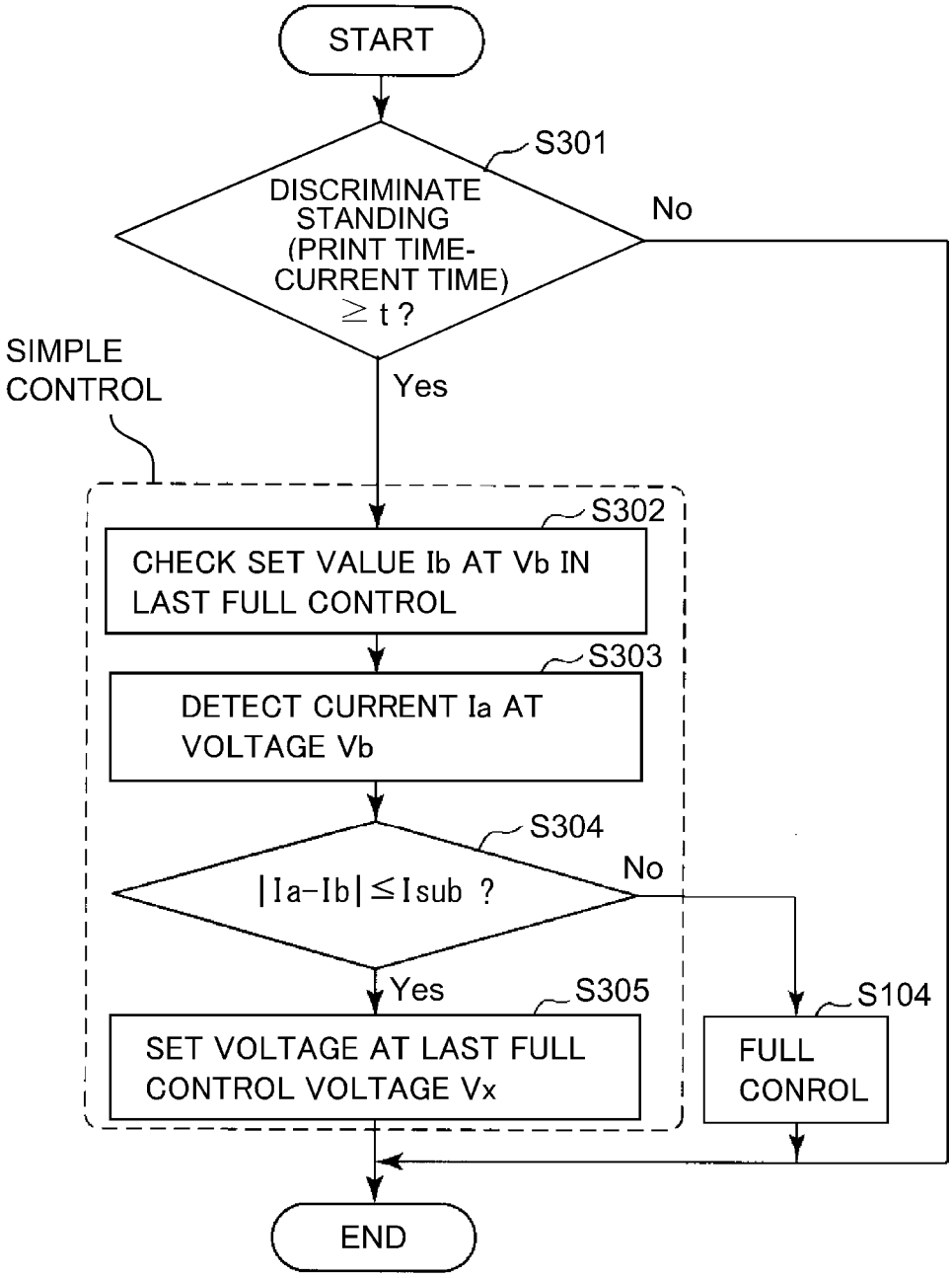
FIG. 6 is a flow chart for illustrating simple control and selection control in which one is selected from a first mode and a second mode and is executed in the embodiment of the present invention.

FIG. 6 shows a flow chart of the simple control and the full control (selection control) in which one is selected from the first mode and the second mode on the basis of the result of the simple control. Here, control not in the case where the power switch 120 is turned on but in the case where whether or not the full control is carried out is discriminated in the state in which the power switch 120 is turned on will be described. However, the control described below can be carried out similarly immediately before execution of full control of another discharge current control.

First, similarly as in S101 in FIG. 5, the image forming signal is sent from the operating portion 130 of the image forming apparatus 100 to the CPU 110, and the CPU 110 discriminates the standing state similarly as in the case of S103 in FIG. 5 on the basis of the time obtained from the timer 16 in S102 in FIG. 5 (S301). Then, the CPU 110 carries out the simple control described below in the case where the CPU 110 discriminates that the timing is after the standing.

Next, the simple control which is the check mode corresponding to S302 to S305 in FIG. 6 will be described.

The CPU 110 reads out, from the RAM 117, specific AC voltage Vb and AC current Ib which are obtained by full control of last discharge current (S302). This specific AC voltage Vb may preferably be any of the above described $V\alpha1$ to $V\alpha3$ and $V\beta1$ to $V\beta3$. This is because actually measured values of the corresponding currents $Ib=I\alpha1$ to $I\alpha3$ and $I\beta1$ to $I\beta3$ are stored. As a result, simpler control becomes possible. However, the specific AC voltage Vb may be an arbitrary value, and a corresponding current can be obtained from the above-mentioned approximated line by calculation.

Next, the CPU 110 applies the charging bias Vb (having the same AC voltage value as the above specific AC voltage) from the charging high voltage source 20 to the charging roller 2, and an AC current Ia at that time is measured by the ammeter 14 which is the detector (S303).

In this embodiment, the AC voltage Vb which is the charging bias was the AC voltage $V\alpha1$ (=800 Vpp) used in the full control of the discharge current control. This is because the electric discharge to the charging roller 2 is suppressed.

Incidentally, as an example, the detected current Ia=464 $\alpha$A by application of the charging bias is satisfied.

In this way, in the simple control, with respect to the charging bias, only one voltage value is applied to the charging roller 2. On the other hand, in the full control, as the test bias, the six voltage values were applied to the charging roller 2. In this way, in the simple control, typically, only one point is selected from the plurality of voltage values in the full control, and is used as the charging bias. As a result, the sum of peak-to-peak voltages of the AC voltages applied to the charging roller 2 in the full control is 7500 Vpp, whereas the sum of peak-to-peak voltages of the AC voltages applied to the charging roller 2 in the simple control is 800 Vpp. Accordingly, the sum of the peak-to-peak voltages of the AC voltages applied to the charging roller 2 in the simple control can be suppressed to a small value compared with the sum of the peak-to-peak voltages of the AC voltages applied to the charging roller 2 in the full control. In this case, in general, the sum of values (absolute values) of currents flowing into the charging roller 2 in the simple control becomes smaller than the sum of values (absolute values) of currents flowing into the charging roller in the full control. Further, in this case, in general, an amount (absolute value) of electricity moved in the charging roller 2 in the simple control becomes smaller than an amount (absolute value) of electricity moved in the charging roller 2 in the full control. As a result, it is possible to suppress a deterioration of the charging roller 2. Further, as described above, the value of the AC voltage applied to the charging roller 2 is set at a value in the undischarging region in the simple control, whereby the deterioration of the charging roller 2 can be suppressed to the possible extent.

As described above, the number of points of the voltage values of the charging bias is decreased compared with the number of points of the test bias, whereby the deterioration due to the energization and discharge to the charging roller 2 can be suppressed. Also in the case where a plurality of points of the charging bias are used, the number of the points is made smaller than the number of points of the test bias, whereby it is possible to suppress the deterioration due to the energization and discharge to the charging roller 2. Next, in this embodiment, the CPU 110 calculates a current difference |Ia−Ib| from the AC current Ib (=Iα1) obtained in the full control of last discharge current control and the AC current Ia detected in a current (present) check mode, and compares the current difference with a predetermined value (hereinafter referred to as a "set control current") Isub (S304). In this embodiment, the set control current Isub=20 μA was satisfied.

In the case where the CPU 110 as the selector discriminates that the current difference |Ia−Ib| is not more than the set control current Isub in S304, the CPU 110 executes the second mode, without executing the full control of the discharge current control which is the test mode, in which the charging AC voltage during the image formation is set at the charging AC voltage value Vx determined in the full control of the last discharge current control (S305).

On the other hand, in the case where the CPU 110 as the selector discriminates that the current difference |Ia−Ib| is larger than the set control current Isub in S304, the CPU 110 executes the full control of the discharge current control which is the test mode, and executes the first mode in which the regulator regulates the peak-to-peak voltage of the AC voltage to be applied to the charging member 2 by using the value of the AC current detected by the current regulating means 14 when the AC voltage is applied from the applying means 20 to the charging member 2 and in which the charging AC voltage value Vx for subsequent image formation is set (S104). Often this case is the case where a temperature or humidity in a disposition environment is changed or the case where the charging roller or the process cartridge in which the charging roller is incorporated is exchanged. In such a case, the simple current control cannot meet the case, and therefore the contact is effected.

Thereafter, the CPU 110 causes the image forming apparatus to perform the image forming operation similarly as in S106 in FIG. 5.

Embodiment 2

Next, another embodiment of the present invention will be described. A basic structure and operation of an image forming apparatus in this embodiment are the same as those in Embodiment 1. Accordingly, elements having the same or corresponding functions and structures as those in Embodiment 1 will be omitted from detailed description by adding the same reference numerals or symbols thereto.

In this embodiment, control in the case where the power switch 120 is turned on will be described.

Figure 7:
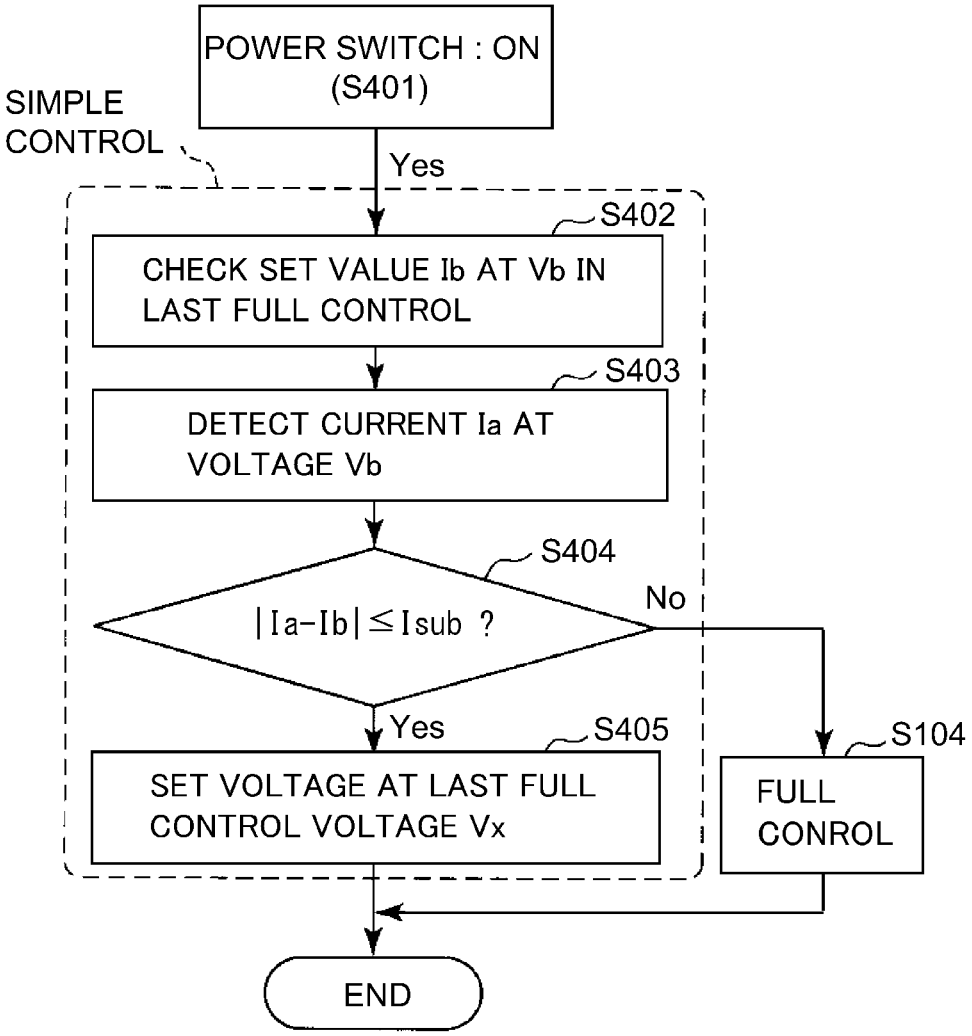
FIG. 7 is a flowchart for illustrating simple control and selection control in which one is selected from a first mode and a second mode and is executed in an embodiment of the present invention.

FIG. 7 shows a flowchart of simple control and control (selection control) in which one is selected from the first mode and the second mode on the basis of a result of the simple control.

First, the power switch 120 which is the hand switch of the image forming apparatus is turned on, and a power source is turned on for the image forming apparatus (S401).

Next, the CPU 110 effects the simple control. The simple control and the control (selection control) in which one is selected from the first mode and the second mode on the basis of the result of the simple control and is executed (S402-S405) are the same as the control described in Embodiment 1, and therefore description will be omitted.

After the simple control, the image forming apparatus goes to a stand-by mode in which the image forming apparatus waits for input of the image forming signal.

Embodiment 3

Next, another embodiment of the present invention will be described. A basic structure and operation of an image forming apparatus in this embodiment are the same as those in Embodiment 1. Accordingly, elements having the same or corresponding functions and structures as those in Embodiment 1 will be omitted from detailed description by adding the same reference numerals or symbols thereto.

In this embodiment, control in the case where the power switch 120 is turned on will be described.

Figure 8:
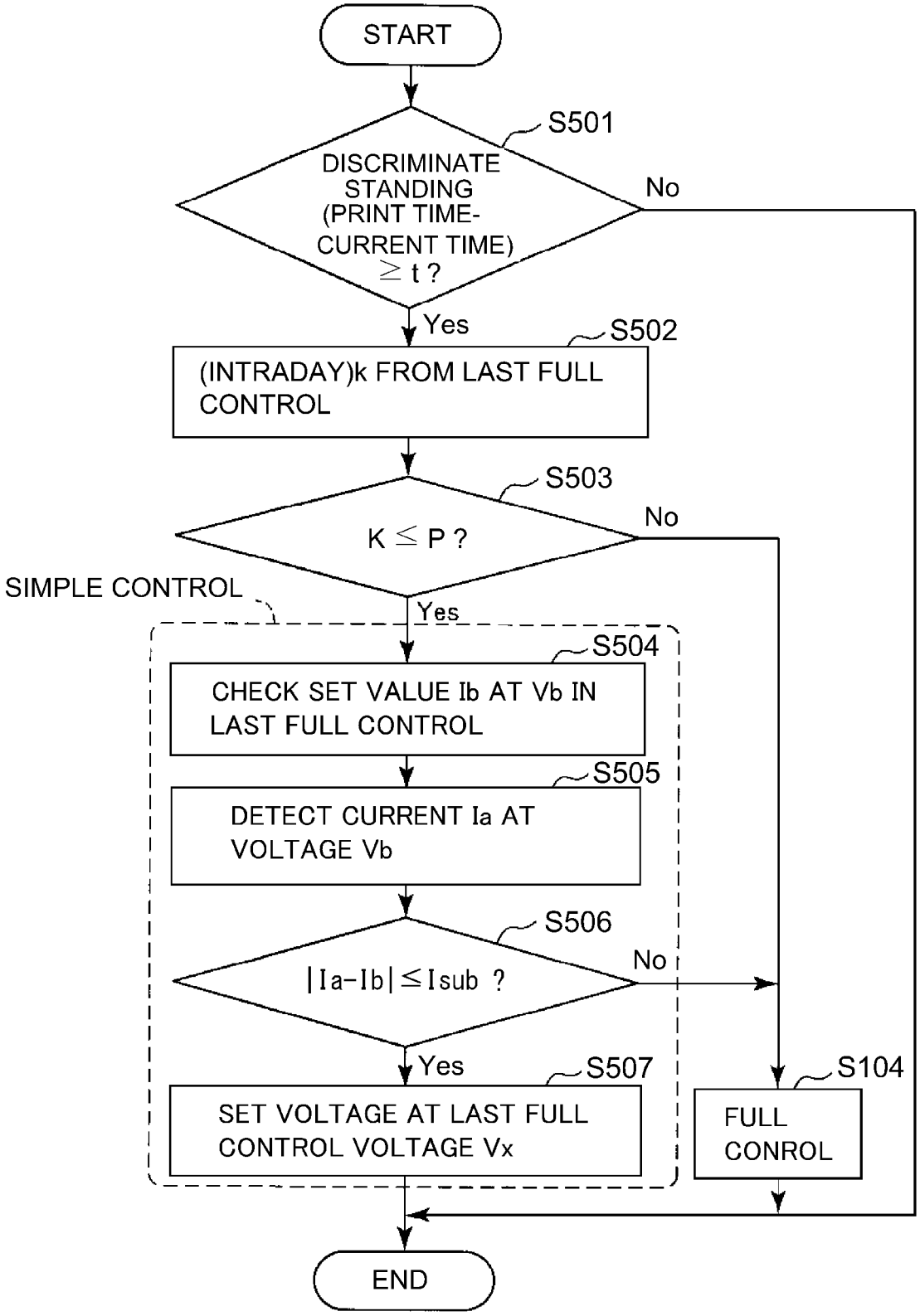
FIG. 8 is a flowchart for illustrating switching control for switching discharge current control to simple control and for illustrating the simple control in an embodiment of the present invention.

FIG. 8 shows a flowchart of control (switching control) in which whether or not the discharge current control is switched to the simple control and control (selection control) in which one is selected from the first mode and the second mode on the basis of a result of the simple control. This flowchart is, compared with the flowchart in Embodiment 1, different in that a checking operation for checking the intraday sheet number k which is the sheet number from the last full control is performed before the simple control.

First, the CPU 110 discriminates the standing state similarly as in the case of S103 in FIG. 5 on the basis of that the time obtained from the timer 16 in S102 in FIG. 5 (S501). Then, in the case where the CPU 110 discriminates that the timing is after the standing, the CPU 110 reads the intraday sheet number k from the counter 16 (S502).

Next, the CPU 110 compares the intraday sheet number k with a predetermined sheet number (hereinafter referred to as a "control switching sheet number") P, and checks whether or not the intraday sheet number k is not less than the control switching sheet number P (S503). This control switching sheet number is always a value smaller than the above-mentioned control execution sheet number Pu. In this embodiment, the control switching sheet number P=99 sheets was determined. However, this value can be appropriately set depending on a degree of the change in electric resistance of the charging roller 2, or the like.

Incidentally, in this embodiment, the image formation sheet number is used as a discrimination reference for discriminating whether or not the discharge current control is switched to the simple control, but the present invention is limited thereto. For example, an application time of the charging voltage to the charging roller 2, a rotation time or rotation number of the charging roller 2 or a rotation time or rotation number of the photosensitive drum 1, or the like may also be used as the discrimination reference. That is, as the threshold for discriminating whether or not the discharge current control is switched to the simple control, it is possible to arbitrarily utilize information (parameter) correlated with a use amount of the charging roller 2. Further, the CPU 110 executes the full control of the discharge current control in the case where the CPU 110 discriminates that the intraday sheet number k is larger than the control switching sheet number P in S503 (S104).

On the other hand, the CPU 110 executes the simple control in the case where the CPU 110 discriminates that the intraday sheet number k is larger than the control switching sheet number P in S503.

The simple control and the control (selection control) in which one is selected from the first mode and the second mode on the basis of the result of the simple control and is executed (S504-S507) are the same as the control described in Embodiment 1, and therefore description will be omitted.

Incidentally, with respect to the check mode in Embodiments 1 to 3 described above, an operation in which at least the charging bias is applied to the charger is called the check mode. Further, the peak-to-peak voltage of the charging bias applied in the check mode is not necessarily be equal to the test bias but may also be a different peak-to-peak voltage. In that case, a comparison value for the current value detected when the charging bias is applied is determined from a relation between the peak-to-peak voltage value of the test bias applied in the test mode and the current value detected at that time.

6. Confirmation of Effect

Next, a result of confirmation of an effect by the control in this embodiment will be described.

In the image forming apparatus in this embodiment and an image forming apparatus in Comparison Example, by using an image of 30% in image duty (print ratio), an image was outputted in groups of two sheets while changing the intraday sheet number from 2 sheets to 50 sheets, and a lifetime of the charging roller 2 was compared. Incidentally, the image forming apparatus in Comparison Example was the same as the image forming apparatus in this embodiment except that the switching control of the discharge current control and the simple control which are described with reference to FIGS. 6, 7 and 8 are not carried out.

TABLE 1

| Intraday sheet number k (sheets) | Charging roller lifetime (%) Comparison Example | This embodiment |
|---|---|---|
| 2 | 58 | 92 |
| 5 | 83 | 97 |
| 10 | 92 | 98 |
| 50 | 98 | 100 |

Timing when the image defects due to the contamination with the toner are generated was discriminated as the lifetime of the charging roller 2. That is, when the charging roller 2 is deteriorated by energization to the charging roller 2, a streak-like image defect resulting from charging non-uniformity is generated. This is discriminated as the lifetime of the charging roller 2. Further, a lifetime (voltage application time to the charging roller 2) of the charging roller 2 in the case where the image forming apparatus in this embodiment is used with the intraday sheet number of 200 sheets or more which is sufficiently large was taken as 100% of the reference lifetime of the charging roller 2.

As shown in Table 1, in the image forming apparatus in Comparison Example in the case where the image forming apparatus is used with the intraday sheet number k=50 sheets, the charging roller lifetime becomes 98%. Similarly, the charging roller lifetime becomes 92% for the intraday sheet number k=10 sheets, 83% for the intraday sheet number k=5 sheets, and 58% for the intraday sheet number k=2 sheets. That is, in the image forming apparatus in Comparison Example, the intraday sheet number k largely influences the lifetime of the charging roller.

On the other hand, in the image forming apparatus in this embodiment, in the case where the image forming apparatus is used with the intraday sheet number k=50 sheets, the charging roller lifetime becomes 100%. Similarly, the charging roller lifetime becomes 98% for the intraday sheet number k=10 sheets, 97% for the intraday sheet number k=5 sheets, and 92% for the intraday sheet number k=2 sheets. That is, in the image forming apparatus in this embodiment, it is understood that the charging roller lifetime is prolonged compared with the image forming apparatus in Comparison Example.

From the control time, validity of the effect by the control in this embodiment will be considered. First, when the control time of the control in Comparison Example is estimated, the voltage application time to the charging roller by the control (pre-multi-rotation operation) carried out during the turning-on of the power switch is 5 seconds in average. A breakdown of the control includes the full control of the discharge current control, the charging roller cleaning and the control for uniformizing the photosensitive drum potential. On the other hand, when the control time of the control in this embodiment is estimated, the voltage application time to the charging roller by the control (pre-multi-rotation operation) carried out during the timing-on of the power switch is 0.5 second in average. Further, in Comparison Example and in this embodiment, the voltage application time to the charging roller in the case where the two-sheet image formation is effected is 6 seconds in average.

In this case, when the case where the image formation and the control is repeated is estimated on the assumption that about 50000 sheets correspond to the intraday sheet number k of 2 sheets, the charging roller lifetime in the image forming apparatus in Comparison Example is estimated as 55%, and the charging roller lifetime in the image forming apparatus in this embodiment is estimated as 90%. For that reason, it would be considered that interrelation is established between this estimation result and actual data.

Further, with respect to a user who does not so form the color image by the image forming apparatus having a monochromatic mode (a mode in which the voltage is not applied to the charging roller for YMC colors but is applied to the charging roller for only block), the case where the intraday sheet number k is less at the image forming portions for the YMC colors can occur. In such a case, a larger effect by the control in this embodiment can be expected.

Further, if the image forming apparatus is a high-speed machine, the image formation time becomes short and a ratio of the image formation time to the control time is small, and therefore if the control time can be shortened by the control in this embodiment, the effect of this embodiment in throughput of the image forming apparatus becomes larger.

As described above, according to this embodiment, it is possible to suppress the deterioration of the charging device although the time actually subjected to the image formation is short by selecting and executing one from the plurality of modes including the first mode in which the simple control which is the check mode is carried out and the charging bias is set by executing the test mode on the basis of the current detected in the check mode and the second mode in which the charging bias regulated through the last test mode without executing the test mode is set. Further, in the case where the frequency of use of the image forming apparatus is low, it is possible to suppress the deterioration of the photosensitive member resulting from the excessive discharge current control.

Other Embodiments

In the above-described embodiments, the case where the peak-to-peak voltage value of the actual charging voltage subjected to the constant-voltage-control during image formation is obtained by changing the peak-to-peak voltage values of the AC voltages applied to the charging roller in the discharge current control and by measuring corresponding AC current values, respectively, was described by citing specific examples. On the other hand, as described above it is possible to obtain the charging AC current value subjected to the constant-current-control during the image formation by changing values of the AC currents applied to the charging roller in the discharge current control and by measuring corresponding peak-to-peak voltages of the AC voltages, respectively.

Even in this case, it is possible to obtain the charging AC current value subjected to the constant-current-control during the image formation. In such an example, the number of the charging biases in the simple control which is the check mode is made smaller than the number of the test biases in the full control which is the test mode, so that the sum of the absolute values of the values of the AC currents applied to the charging roller is small. In this case, in general, the amount (absolute value) of electricity moved in the charging roller in the simple control becomes smaller than the amount (absolute value) of electricity moved in the charging roller in the full control. Further, as is understood from the above-mentioned embodiments, it is preferable that the AC current value of the test bias in the simple control is selected from the AC values utilized in the full control and is used. Further, the peak-to-peak voltage of the AC voltage at that time is obtained, and it is only required that the second mode is selected and executed in the case where the difference between that value and the peak-to-peak voltage value of the AC voltage corresponding to the AC current value which is the same value as that in the last full control is the predetermined value or less, and the first mode is selected and executed if the difference is larger than the predetermined value.

Further, in the above-mentioned embodiments, the charging member was described as being the roller type, but the present invention is not limited to this and may also be of a blade type, a brush type, a sheet type, and the like.

INDUSTRIAL APPLICABILITY

According to the present invention, there is provided an image forming apparatus capable of suppressing the deterioration of the charger by carrying out the discharge current control every timing on of the power switch or every start of the image formation after the lapse of the predetermined time from the end of the last image formation although the time actually subjected to the image formation.

The invention claimed is:

1. An image forming apparatus comprising:

a photosensitive member;

a charger for electrically charging said photosensitive member when an image is formed on said photosensitive member;

a bias applying device for applying, to said charger, a charging bias including a DC voltage and an AC voltage which are superimposed;

a detector for detecting a current passing through said charger;

a regulator for regulating a peak-to-peak voltage of the charging bias on the basis of a current detected by said detector when a plurality of test biases, different in peak-to-peak voltage from each other, are applied in a test mode in which the plurality of test biases are applied to said charger; and a selector for selecting one from a plurality of modes including a first mode, in which the charging bias is set by executing the test mode, and including a second mode, in which the charging bias regulated through a last test mode without executing the test mode is set, on the basis of the current detected by said detector when at least one check bias smaller in number than a number of kinds of the test biases is applied in a check mode, in which the check bias is applied after a power source of said image forming apparatus is turned on and before an image formation start signal is inputted.

2. An image forming apparatus according to claim 1, wherein the charging bias applied to said charger in the check mode is single, and the peak-to-peak voltage of the charging bias is the same as one of the plurality of test biases in the last test mode, and wherein said selector selects the first mode in a case where a difference between a current detected by said detector when the test bias is applied in the last test mode and a current detected when the charging bias having the peak-to-peak voltage which is the same as the test bias is applied in the check mode is a predetermined value or more, and selects the second mode in a case where the difference is less than the predetermined value.

3. An image forming apparatus according to claim 1, wherein a plurality of charging biases different in peak-to-peak voltage are applied to said charger in the check mode, and the peak-to-peak voltages of the plurality of charging biases are the same as a part of the plurality of test biases in the last test mode, and wherein a difference between a result detected by said detector when the test bias is applied in the last test mode and a result detected when the charging bias having the peak-to-peak voltage which is the same as the test bias is applied in the check mode is calculated for each of the plurality of charging biases, and said selector selects the first mode in a case where at least one of the plurality of differences is out of a predetermined range, and selects the second mode in a case where all the plurality of differences are within the predetermined range.

4. An image forming apparatus according to claim 1, wherein the test biases are at least one test bias having the peak-to-peak voltage less than two times Vth, where a discharge start voltage to said photosensitive member when a DC voltage is applied to said charger is Vth, and are the plurality of test biases different in peak-to-peak voltage which is larger than two times Vth.

5. An image forming apparatus according to claim 4, wherein the peak-to-peak voltage of the charging bias is less than two times Vth.

6. An image forming apparatus according to claim 1, wherein said charger is provided so as to be contactable to said photosensitive member.

7. An image forming apparatus comprising:

a photosensitive member;

a charger for electrically charging said photosensitive member when an image is formed on said photosensitive member;

a bias applying device for applying, to said charger, a charging bias including a DC voltage and an AC voltage which are superimposed;

a detector for detecting a current passing through said charger;

a regulator for regulating a peak-to-peak voltage of the charging bias on the basis of a current detected by said detector when a plurality of test biases, different in peak-to-peak voltage from each other, are applied in a test mode in which the plurality of test biases are applied to said charger; and a selector for selecting one from a plurality of modes including a first mode, in which the charging bias is set by executing the test mode, and including a second mode, in which the charging bias regulated through a last test mode without executing the test mode is set, on the basis of the current detected by said detector when at least one check bias smaller in number than a number of kinds of the test biases is applied in a check mode, in which the check bias is applied in a case where an image formation start signal is inputted after a lapse of a predetermined time from an end of a last image formation and before image formation is started.

8. An image forming apparatus according to claim 7, wherein the charging bias applied to said charger in the check mode is single, and the peak-to-peak voltage of the charging bias is the same as one of the plurality of test biases in the last test mode, and wherein said selector selects the first mode in a case where a difference between a current detected by said detector when the test bias is applied in the last test mode and a current detected when the charging bias having the peak-to-peak voltage which is the same as the test bias is applied in the check mode is a predetermined value or more, and selects the second mode in a case where the difference is less than the predetermined value.

9. An image forming apparatus according to claim 7, wherein a plurality of charging biases different in peak-to-peak voltage are applied to said charger in the check mode, and the peak-to-peak voltages of the plurality of charging biases are the same as a part of the plurality of test biases in the last test mode, and wherein a difference between a result detected by said detector when the test bias is applied in the last test mode and a result detected when the charging bias having the peak-to-peak voltage which is the same as the test bias is applied in the check mode is calculated for each of the plurality of charging biases, and said selector selects the first mode in a case where at least one of the plurality of differences is out of a predetermined range, and selects the second mode in a case where all the plurality of differences are within the predetermined range.

10. An image forming apparatus according to claim 7, wherein the test biases are at least one test bias having the peak-to-peak voltage less than two times Vth, where a discharge start voltage to said photosensitive member when a DC voltage is applied to said charger is Vth, and are the plurality of test biases different in peak-to-peak voltage which is larger than two times Vth.

11. An image forming apparatus according to claim 10, wherein the peak-to-peak voltage of the charging bias is less than two times Vth.

12. An image forming apparatus according to claim 7, wherein said charger is provided so as to be contactable to said photosensitive member.

13. An image forming apparatus comprising:

a photosensitive member;

a charger for electrically charging said photosensitive member when an image is formed on said photosensitive member;

a bias applying device for applying, to said charger, a charging bias including a DC voltage and an AC voltage which are superimposed;

a detector for detecting a peak-to-peak voltage of a voltage applied to said charger;

a regulator for regulating a current of the charging bias on the basis of the peak-to-peak voltage detected by said detector when a plurality of test biases, different in peak-to-peak voltage from each other, are applied in a test mode in which the plurality of test biases are applied to said charger; and a selector for selecting one from a plurality of modes including a first mode, in which the charging bias is set by executing the test mode, and including a second mode, in which the charging bias regulated through a last test mode without executing the test mode is set, on the basis of the peak-to-peak voltage detected by said detector when at least one check bias smaller in number than a number of kinds of the test biases is applied in a check mode, in which the check bias is applied after a power source of said image forming apparatus is turned on and before an image formation start signal is inputted.

* * * * *